US005639180A

United States Patent [19]

Sulosky et al.

[11] Patent Number: 5,639,180

[45] Date of Patent: Jun. 17, 1997

[54] MILLED ROADWAY SURFACE

[75] Inventors: William P. Sulosky, Davidsville; Wayne H. Beach, Roaring Spring, both of Pa.

[73] Assignees: Kennametal Inc., Labrobe; Advanced Cutting Systems Corp., Davidsville, both of Pa.

[21] Appl. No.: 660,984

[22] Filed: Jun. 12, 1996

Related U.S. Application Data

[62] Division of Ser. No. 437,163, May 8, 1995, Pat. No. 5,536, 073.

[51] Int. Cl.[6] ..... E01C 23/09

[52] U.S. Cl. ..... 404/17; 404/93; 299/39.8

[58] Field of Search ..... 299/39.4, 39.8, 299/39.9, 87.1; 404/15, 19, 90, 91, 93, 94, 17

[56] References Cited

U.S. PATENT DOCUMENTS

| | | | |
|---|---|---|---|
| 2,737,378 | 3/1956 | Barrett | 299/84.1 |
| 3,325,219 | 6/1967 | Guillon et al. | 299/101 |
| 3,409,330 | 11/1968 | Hatcher et al. | 299/39.4 |
| 3,775,018 | 11/1973 | Barton | 404/93 |
| 4,006,937 | 2/1977 | Crabiel | 299/43 |
| 4,068,897 | 1/1978 | Amoroso | 299/102 |
| 4,186,968 | 2/1980 | Barton | 299/39.2 |
| 4,614,379 | 9/1986 | Wirtgen | 299/39.8 |
| 4,621,871 | 11/1986 | Salani | 299/107 |
| 4,720,207 | 1/1988 | Salami | 404/90 |
| 4,784,517 | 11/1988 | Bergqvist et al. | 404/75 |
| 4,900,094 | 2/1990 | Sergeant | 404/94 X |
| 5,052,757 | 10/1991 | Latham | 299/87.1 |
| 5,098,167 | 3/1992 | Latham | 299/104 |

FOREIGN PATENT DOCUMENTS

| | | |
|---|---|---|
| 2459329 | 1/1981 | France . |
| 2695665 | 3/1994 | France . |
| 2148304 | 4/1973 | Germany . |
| 3644601 | 7/1988 | Germany . |
| 697714 | 11/1979 | U.S.S.R. . |
| 777152 | 7/1980 | U.S.S.R. . |
| 1079835 | 3/1984 | U.S.S.R. . |
| 856226 | 12/1960 | United Kingdom . |
| 1163412 | 4/1969 | United Kingdom . |
| 2042028 | 9/1980 | United Kingdom . |
| 9324282 | 12/1993 | WIPO . |

OTHER PUBLICATIONS

Kennametal Drawing No. 844–01149–4 (Sep. 26, 1976).
Kennametal Drawing No. 804–01144 (Jan. 4, 1979).
Kennametal Drawing No. 804–01097 (Apr. 11, 1977).
Kennametal Drawing No. 804–01096 (Apr. 6, 1977).
Kennametal Drawing No. 804–01084 (May 4, 1976).
Brochure from Keystone Engineering & Manufacturing on Taper Lock System (undated).
Sketch of Keystone Tri–Bit/Block Arrangement (undated).
Kennametal Drawing No. 844–01505 (Feb. 2, 1990).

*Primary Examiner*—David J. Bagnell
*Attorney, Agent, or Firm*—John J. Prizzi

[57] ABSTRACT

A mining drum assembly for use in the mining of a substrate that has a drum. A plurality of bars, each one of the bars has a plurality of laterally-spaced apart mining bit assemblies connected thereto, are affixed to the surface of the drum. The bars define first and second regions of discrete bars equi-spaced about the circumference of the drum. The bars of the first region being circumferentially and laterally spaced-apart from the bars of the second region.

3 Claims, 9 Drawing Sheets

MILLED ROADWAY SURFACE

This is a divisional of application Ser. No. 08/437,163 filed on May 8, 1995, now U.S. Pat. No. 5,536,073, issued Jul. 16, 1996.

BACKGROUND OF THE INVENTION

This invention pertains to a mining drum assembly for mining a substrate and a method of mining the substrate. More specifically, the invention concerns a drum assembly, and parts of that assembly, for the milling of a roadway substrate to a fine texture. The invention also concerns a method for milling the roadway substrate to a fine texture.

One major component of a road milling machine is the road milling drum. The typical road milling drum of the past comprises a generally cylindrical drum with a plurality of road milling bit-block assemblies directly attached to the surface of the drum. More specifically, the block, which rotatably holds the bit, is welded to the surface of the drum.

The road milling bits are oriented relative to the surface of the drum so that upon the road milling machine powering the drum so as rotate the same the bits impinge upon the roadway substrate and travel through the substrate thereby causing the roadway substrate to disintegrate to a depth equal to the depth of cut for the bit so as to create debris. Typically, the debris is collected and removed from the road milling site. In the case where the roadway substrate is made from an asphaltic material, the debris may be transported to a recycling facility.

The pattern of the road milling bits on the drum is such that each road milling bit impinges upon the substrate at an exclusive discrete point so that the points of impact span the length of the drum. In the past, the typical spacing between the discrete impact points has been about 0.625 inches. While such a spacing of the impact points has been satisfactory for removing the surface layer from the roadway substrate, there have been some undesirable properties of the resultant roadway surface.

Most notably, an impact point spacing of 0.625 inches results in a surface with a coarse texture which leads to a high level of road noise when a vehicle travels over the textured surface. Such a coarse textured surface is irritating to the vehicle driver because of the high noise level and of the fact that the roadway surface is not smooth. The only known way to reduce this road noise from a coarse textured surface is to resurface the roadway with a new layer of roadway material such as, for example, asphaltic material.

Resurfacing the roadway may be acceptable in some circumstances when a resurfaced roadway is necessary. However, when resurfacing is not a necessity, such as in the case where the roadway has been milled to smooth out the surface due to traffic ruts, resurfacing can be an uneconomical approach to solving the problem of a milled roadway with a rough texture.

One approach to solve this problem has been to decrease the impact point spacing so as to make the texture of the milled roadway surface less coarse. While this approach has technical merit, there has been only one manufacturer of road milling drums who has designed a road milling drum with the specific intent to decrease the impact point spacing. In this regard, Keystone Engineering & Manufacturing Company, of Indianapolis, Ind., has designed a road milling bit holder that results in a minimum impact point spacing of about 0.200 inches.

Referring to the design of this holder from Keystone Engineering, it has a rearward shank portion by which the holder is affixed in a pocket of a helical vane on the surface of the drum. The shank terminates at its axially forward end in an enlarged head which has a trio of bores. Each of the bores receives a road milling bit so that the head holds three bits. This holder has a number of drawbacks.

The Keystone Engineering holder is relatively expensive to manufacture. Because of its design and the size of a standard road milling bit, the structure of the current Keystone holder is not conducive to providing impact point spacing below 0.200 inches. Furthermore, while the impact point spacing of 0.200 inches reduces the road noise from surfaces with an impact point spacing of 0.625 inches, there remains a need to decrease even further the impact point spacing so as to produce a milled roadway substrate with a still finer surface texture.

Road milling drums of the past have not been manufactured with modular components. In other words, the road milling drums of the past have been made without regard to using modular pre-manufactured components suitable for use on drums of different designs and bit patterns. By providing a road milling drum made with modular components one would decrease the cost of manufacturing a road milling drum. The use of modular components would also accelerate the time it takes to manufacture a drum, as well as provide for an increase in the design flexibility to make drums of different designs from modular component parts.

Road milling drums must be able to withstand great forces exerted thereon during the road milling operation. To provide any structure that strengthens the road milling drum would be highly desirable.

As can be appreciated, the road milling bits must be changed from time-to-time during the road milling operation since these bits wear out and must be replaced. Although the need to change bits varies with the particular milling conditions, it is not unusual to change bits on a road milling drum at least once per milling shift.

To change a road milling bit, the operator uses a pneumatic hammer to knock the old bit out of the block. Often times there are hundreds of road milling bits on one road milling drum so that the time needed to change an entire drum of bits can be substantial. It would be beneficial to provide a road milling drum that helps the operator gain access to the rear of each road milling bit on the road milling drum.

It is important that the debris generated from the road milling operation be efficiently directed to the location on the milling machine where it is collected and removed from the milling site. It would thus be desirable to provide a road milling drum that enhances the ability of the road milling machine to collect debris for removal from the milling site.

SUMMARY OF THE INVENTION

It is a principal object of the invention to provide an improved mining drum for mining a substrate, as well as an improved method for mining a substrate.

It is another object of the invention to provide an improved road milling drum for milling a roadway substrate, as well as an improved method for milling a roadway substrate.

It is still another object of the invention to provide an improved road milling drum for milling a roadway substrate, and a method for milling a roadway substrate, that provides for a milled roadway substrate having a surface of a fine texture.

It is an additional object of the invention to provide an improved road milling drum for milling a roadway substrate that uses modular components.

It is an object of the invention to provide an improved road milling drum for milling a roadway substrate that has increased structural strength.

It is an object of the invention to provide an improved road milling drum for milling a roadway substrate that facilitates the changing of the road milling bits.

Finally, it is an object of the invention to provide an improved road milling drum for milling a roadway substrate that facilitates the directing of debris to a central collection point on the road milling machine.

In one form thereof, the invention is a mining drum assembly that comprises a drum which has opposite ends and a generally cylindrical surface. A plurality of bars are affixed to the surface of the drum wherein each one of the bars has a plurality of laterally-spaced apart blocks assemblies connected thereto. The bars define a first region of discrete bars equi-spaced about the circumference of the drum. The bars further define a second region of discrete bars equi-spaced about the circumference of the drum. The bars of the first region are circumferentially and laterally spaced-apart from the bars of the second region.

In another form thereof, the invention is a mining drum assembly which comprises a drum that has opposite ends and a generally cylindrical surface with a circular equator equi-distant from the opposite ends of the drum. A plurality of bars are affixed to the surface of the drum on the one side of the equator nearest the one end of the drum so that about one-half of the bars define one peripheral row of the bars adjacent to the one end of the drum.

Each one of the bars has a plurality of laterally spaced-apart mining bit holders connected thereto. The mining bit holders on the one side of the equator define a generally helical pattern that diverges away from the equator of the drum. The mining bit holders on the bars that comprise the peripheral row of the bars define the portion of the generally helical pattern that is adjacent to the one end of the drum.

A plurality of the bars are affixed to the surface of the drum on the other side of the equator nearest the other end of the drum so that about one-half of the bars define another peripheral row of the bars adjacent to the other end of the drum. The mining bit holders on the other side of the equator define a generally helical pattern that diverges away from the equator of the drum.

In still another form thereof, the invention is a bar for attachment to the surface of a road milling drum having a longitudinal length wherein the bar comprises a longitudinal body having a length that is less than one-half of the length of the road milling drum. A plurality of blocks are connected to the bar.

BRIEF DESCRIPTION OF THE DRAWINGS

The following is a brief description of the drawings which form a part of this patent application.

DETAILED DESCRIPTION OF SPECIFIC EMBODIMENTS

Figure 1:
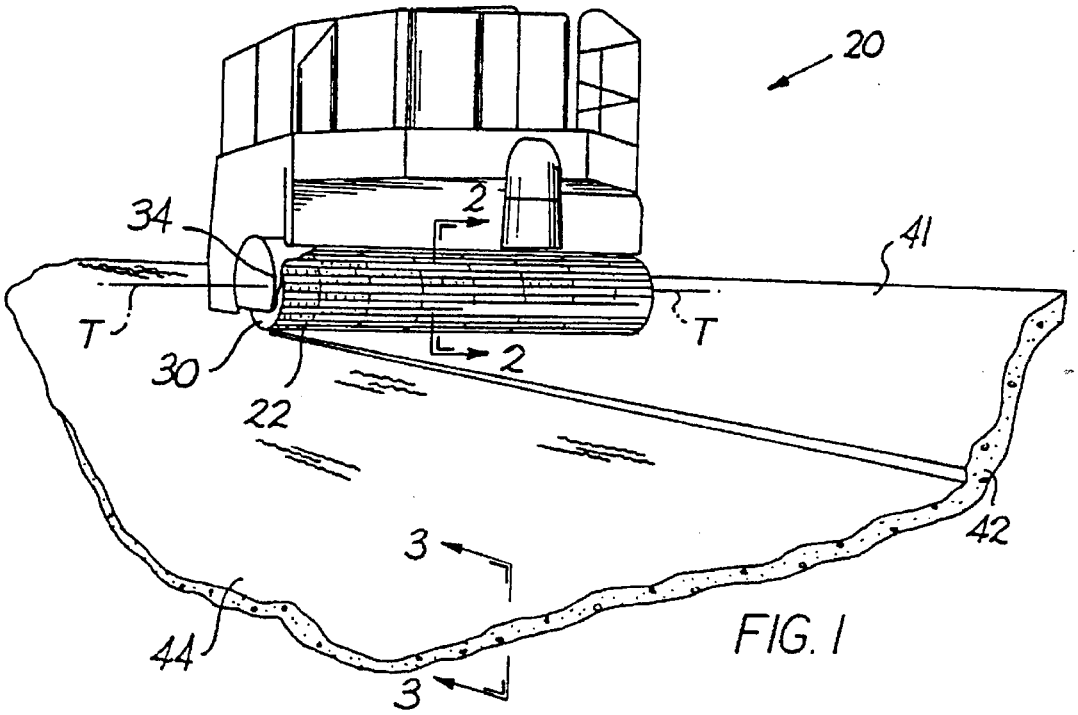
FIG. 1 is a perspective view of a road milling machine milling the surface of a roadway substrate wherein the drawing shows a milled and unmilled surface.

Referring to the drawings, FIG. 1 depicts a road milling machine generally designated as 20. Road milling machine 20 carries a road milling drum assembly 22 which is driven by an engine (not illustrated) which is a part of the road milling machine. The engine drives the drum assembly 22 so as to rotate it in a clockwise direction as viewed in FIG. 2.

Figure 4:
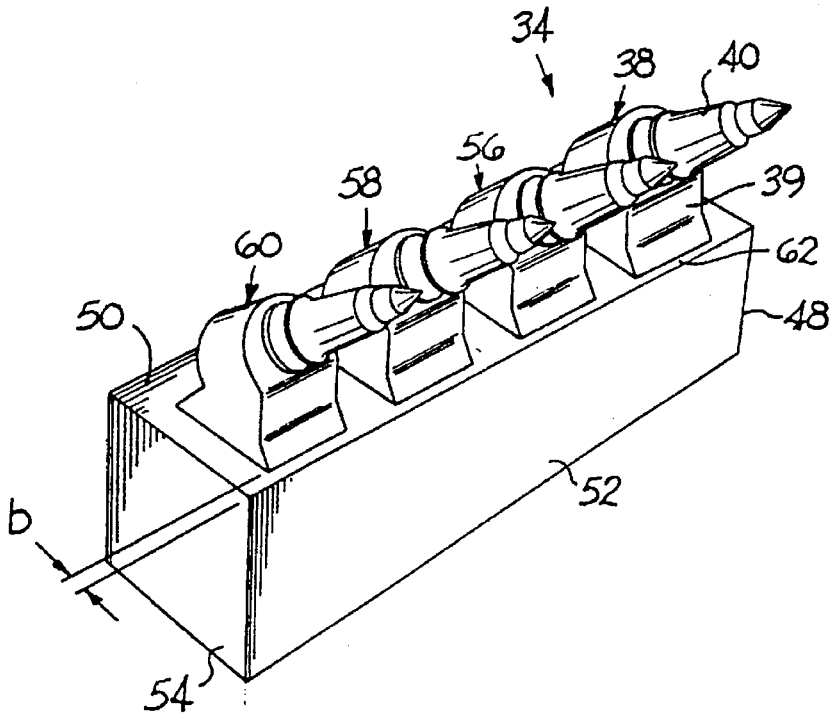
FIG. 4 is perspective view of one specific embodiment of the road milling bar assembly that attaches to the surface of the road milling drum of FIG. 1 wherein this drawing shows the orientation of road milling bit assemblies on the bar so that the forward edge of the block of each road milling bit assembly is the same distance from the front surface of the bar.
Figure 5:
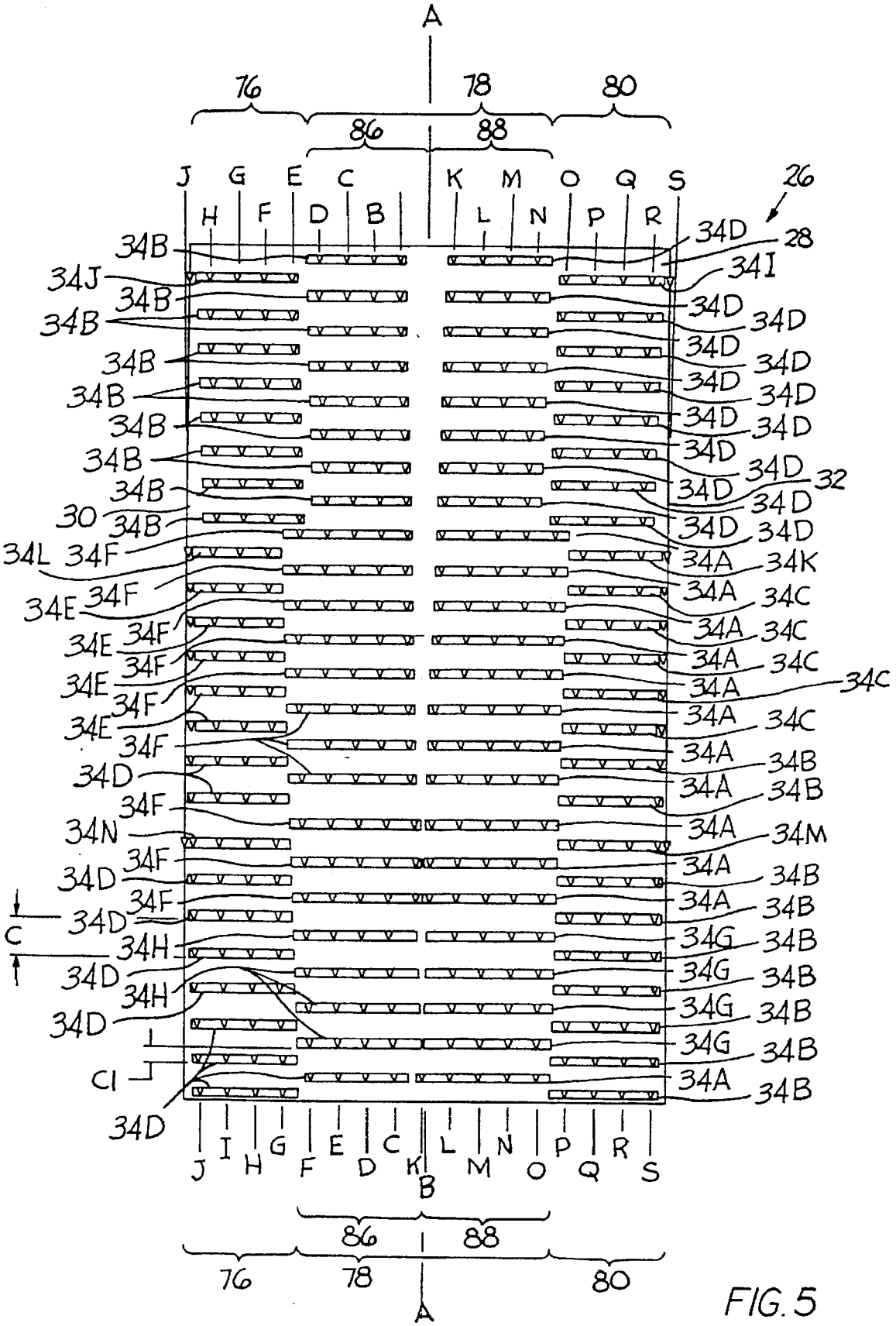
FIG. 5 is a mechanical schematic view of the road milling drum of FIG. 1 showing the overall pattern of the road milling bars, and road milling bits, on the drum.

The road milling drum assembly 22 includes a drum 26 that has a generally cylindrical surface 28 and opposite ends 30 and 32 as depicted in FIGS. 1 and 5. The drum assembly 22 further includes a plurality of road milling bar assemblies generally designated as 34 in FIG. 4.

Referring to FIG. 4, there is illustrated one specific embodiment of a typical road milling bar assembly, which as mentioned earlier is generally designated as 34. Bar assembly 34 includes a road milling bit assembly 38 that has a block 39 which contains a bore that rotatably receives a road milling bit 40. Although a variety of arrangements can retain the bit in the block, U.S. Pat. No. 4,201,421, to DenBesten et al., entitled MINING MACHINE BIT ARRANGEMENT AND MOUNTING THEREOF, discloses one preferred retention arrangement using a resilient split spring sleeve.

Figure 2:
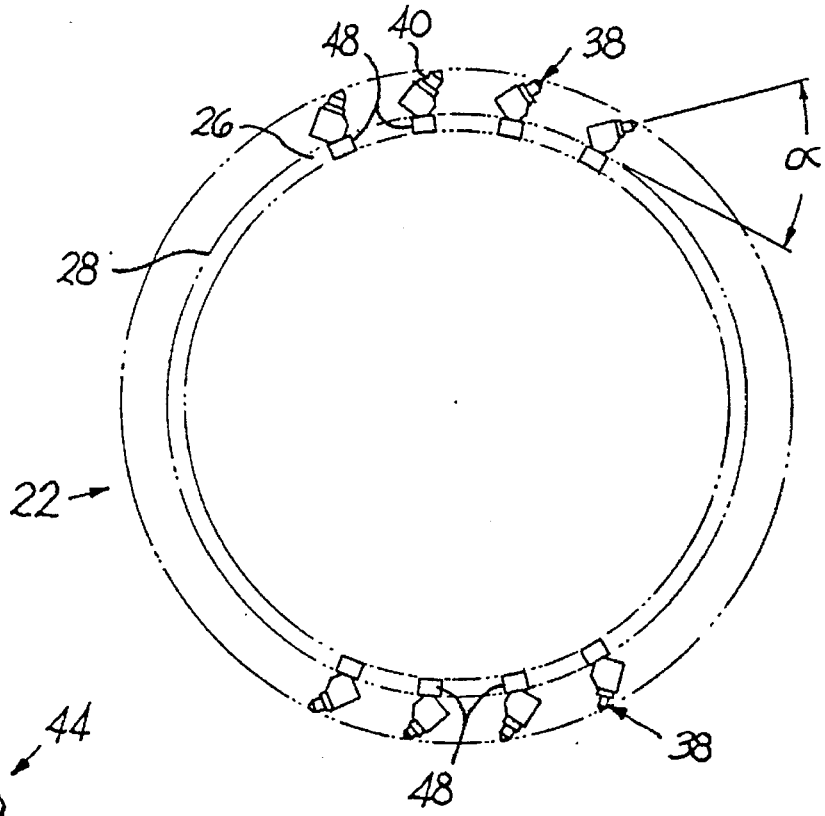
FIG. 2 is a cross-sectional view of the road milling drum assembly from the road milling machine of FIG. 1 taken along a helically-oriented section line 2—2 of FIG. 1.

Bar assembly 34 further includes an elongate generally rectangular bar 48 having a top surface 50, a bottom surface (not illustrated), a front surface 52, a rear surface (not illustrated), and opposite end surfaces 54 and 55. A quartet of road milling bit assemblies 38, 56, 58 and 60 are connected to the top surface 50 of the bar 48. Each road milling bit assembly (38, 56, 58, 60) is the same so that the earlier description of one of the road milling bit assemblies 38 will suffice for a description of the other three road milling bit assemblies (56, 58, 60). In the specific embodiment illustrated in FIG. 4, the road milling bit assemblies 38 are positioned so that the front edge 62 of each block 39 is the same distance "b" away from the front surface 52 of the bar 48. In addition, the bit assemblies are positioned so that the attack angle "α" (in FIG. 2) of the bit is 40 degrees. As shown in FIG. 2, the attack angle α is defined as the angle between the central longitudinal axis of the bit and the tangent to the point at which the central longitudinal axis of the bit intersects the surface of the drum.

Figure 3:
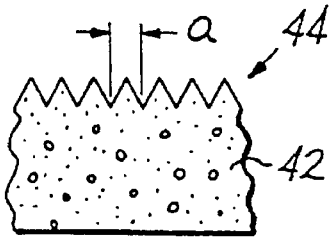
FIG. 3 is a cross-sectional view of the milled roadway substrate taken along section line 3—3 of FIG. 1.

Referring to FIGS. 1 and 3, during the road milling operation, the road milling machine rotates the drum assembly 22 so as to cause the individual road milling bits 40 to impinge upon the unmilled surface 41 of the roadway substrate 42. Upon impingement of the bit 38 with the unmilled surface 41 of the substrate 42 and the subsequent travel of the bit 40 through the substrate 42, the bit 40 will mill (or cut) out a portion of the top layer of the roadway substrate 42 resulting in a roadway substrate 42 with a milled surface 44.

Because each road milling bit 40 has a discrete exclusive point of impingement with the substrate 42 across the length of the drum, the spacing between the adjacent impingement points determines the coarseness or the texture of the roadway surface. Referring to FIG. 3, there is shown a cross-sectional view of a portion of the milled roadway substrate 42 with a milled surface 44. The distance "a" is the distance between the centers of the adjacent impingement points. The advantages of such a narrow spacing of the impact points will be discussed in more detail hereinafter. The design of the present invention permits the spacing between the adjacent points of impingement to be 0.100 inches, and even less than 0.100 inches.

As will become apparent from the description below, all of the bar assemblies 34 are not the same in regard to the position and orientation of the bit assemblies on the bar. These differences will be discussed in conjunction with the description of the pattern of the road milling bars, and road milling bits, on the drum as depicted in FIGS. 5, 5A and FIGS. 6A through 6N.

Referring to FIG. 5, there is illustrated a mechanical schematic view of a road milling bit pattern, as well as the pattern of bars 48, on the drum surface 28 of a specific embodiment of the road milling drum assembly 22. The bars can be made through casting or forging manufacturing techniques. The road milling drum assembly 22 presents an overall pattern wherein the bars define a first region of bars shown in brackets as 76 that is adjacent to the one end 30 of the drum 26 and extends about the circumference of the drum 26. The bars further define a second region of bars shown in brackets as 78 that extends about the circumference of the drum. The bars also define a third region of bars shown in brackets as 80 that is adjacent to the other end 32 of the drum 26 and extends about the circumference of the drum. The second region of bars 78 is mediate between the first and third regions of bars (76, 80).

Referring to the first region of bars 76, it comprises a single row of bars equi-spaced about the circumference of the drum 26. The circumferential spacing "c" between the forward surface of each adjacent bar is such so that each bar is about 15 degrees apart about the circumference of the drum 26. The circumferential spacing "c1" between each bar in the first region of bars 76 and its laterally adjacent bar in the second region of bars 78 is such so that the circumferential spacing is about 7.5 degrees about the circumference of the drum.

As-mentioned earlier, the bar assemblies on the surface of the road milling drum are not all alike so that a description of each separate bar assembly now follows. For ease of description, the various road milling bar assemblies will include an alphabetical suffix that corresponds to the suffix of the series of drawings of FIGS. 6A through 6N.

Beginning at the lower edge of the view of the road milling drum assembly 22 as illustrated in FIG. 5, the first region of bars 76 includes seven circumferentially spaced apart bar assemblies 34D which carry four road milling bit assemblies apiece. Bar assembly 34D is depicted in more detail in FIG. 6D wherein bar 48D has opposite ends 54D and 55D. The overall length "d" of bar 34D is 17.800 inches. The distance "e" between the centers of the adjacent road milling bits is 4.800 inches. The distance "f" that the other end 55D of the bar 48D is spaced away from the center of the road milling bit closest thereto is 2,400 inches. The distance "g" that the one end 54D of the bar 48D is spaced from the center of its closest bit is equal to 1.000 inches.

Figure 5A:
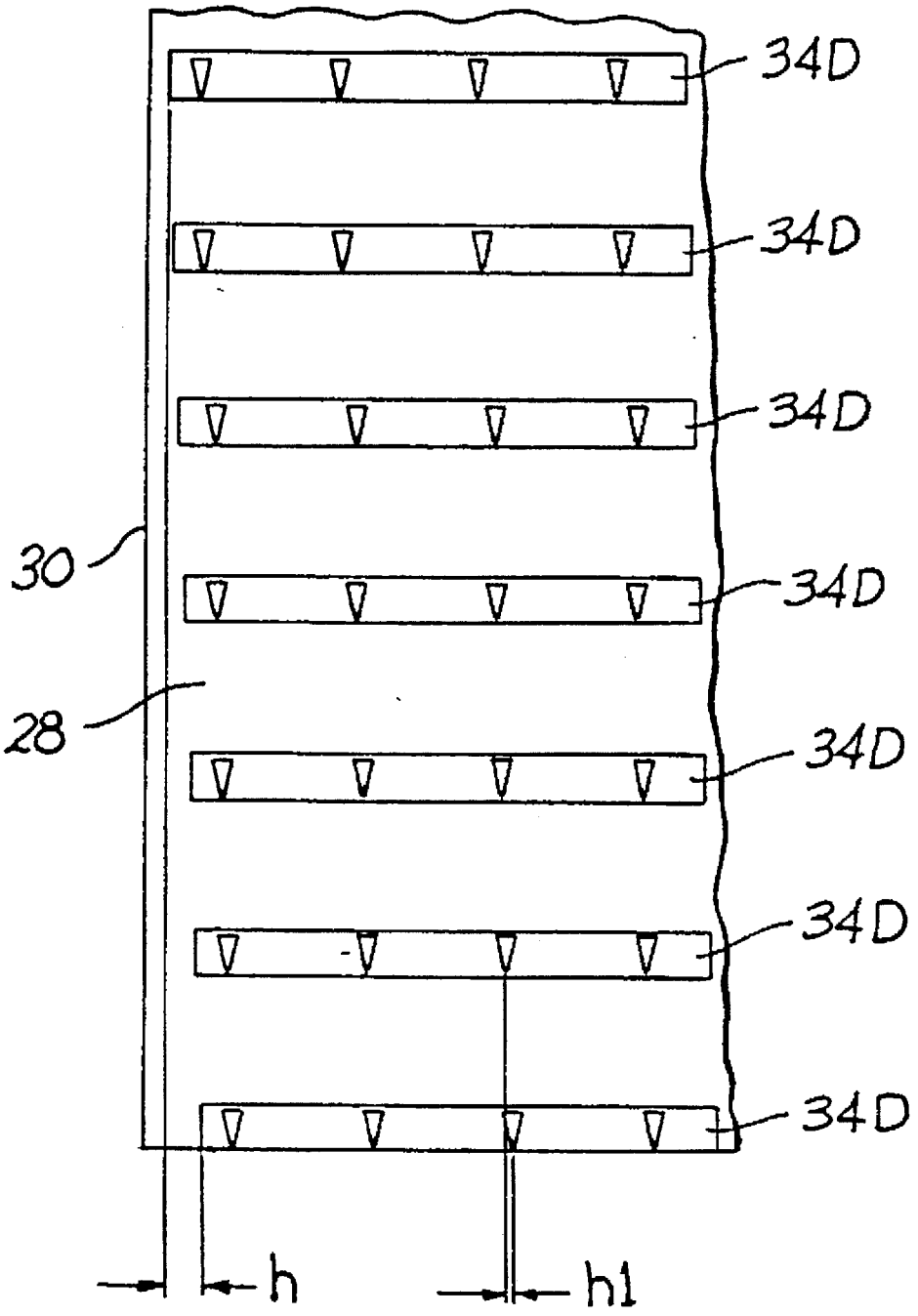
FIG. 5A is a mechanical schematic view of a portion of the road milling drum of FIG. 1 showing the lateral progressive offset of a series of successive bars about a part of the circumference of the drum.

As the bar assemblies 34D move upwardly on the FIG. 5, each of the bars is positioned progressively laterally away from the equator A—A of the drum 26. FIG. 5A clearly shows this lateral progression away from the equator. In this specific embodiment, the total distance of this progression by the seven bars 48D is distance "h", as shown in FIG. 5A, which equals 1.200 inches. This means that the distance of each lateral movement is 0.200 inches. Thus, in this specific embodiment the spacing "h1" between laterally adjacent bits across the length of the drum is 0.200 inches so that the impingement point spacing is 0.200 inches.

While the extent of lateral displacement can vary with the present invention, through the use of the separate bar assemblies the spacing between laterally adjacent bits across the length of the drum can be on the order of 0.100 inches so as to achieve an impingement point spacing of 0.100 inches.

Figure 6A:
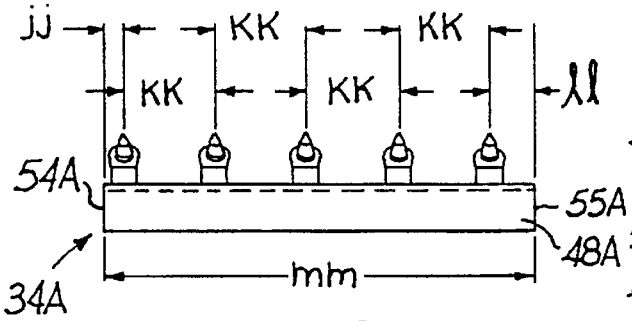
FIGS. 6A through 6N are front views of the modular road milling bar assemblies that comprise the components on the drum assembly of FIG. 5.
Figure 6B:
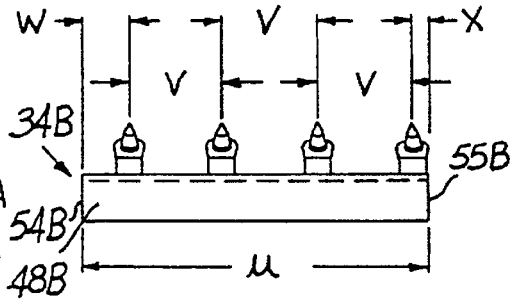
Figure 6C:
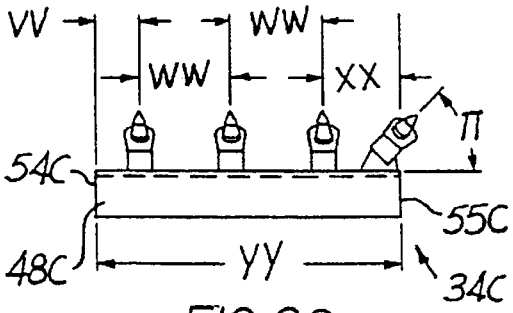
Figure 6D:
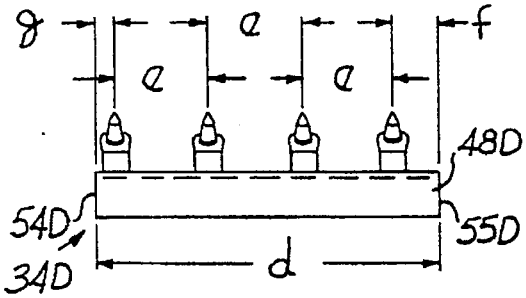
Figure 6E:
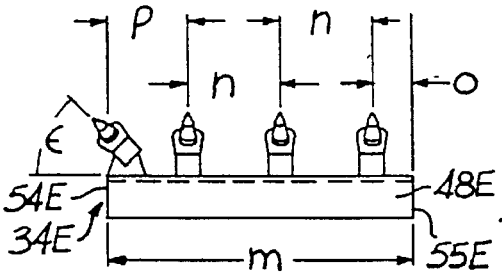
Figure 6F:
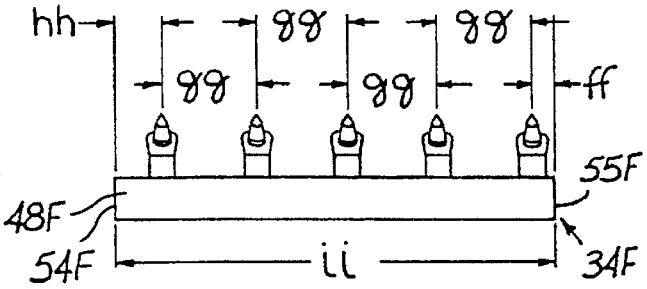
Figure 6G:
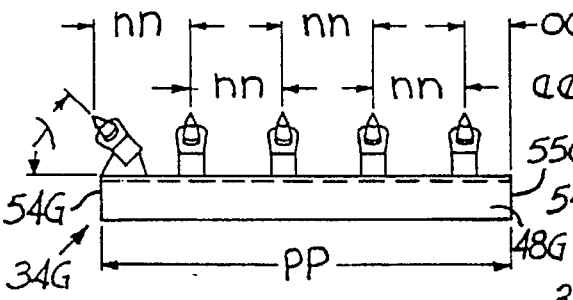
Figure 6H:
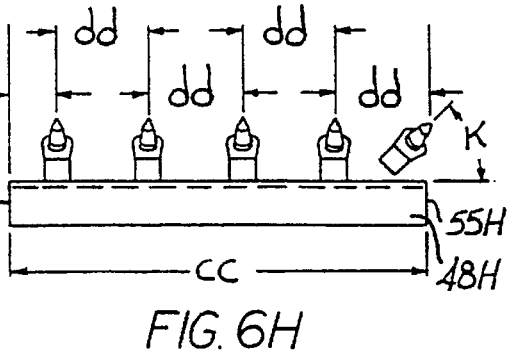
Figure 6I:
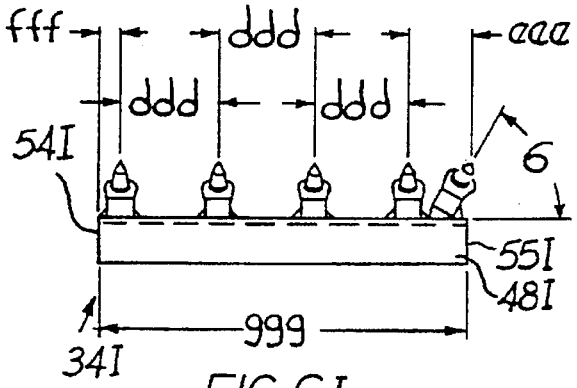
Figure 6J:
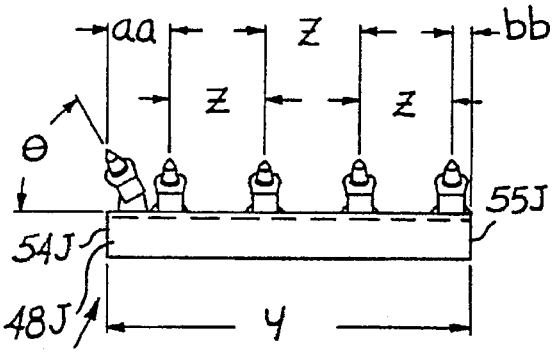
Figure 6K:
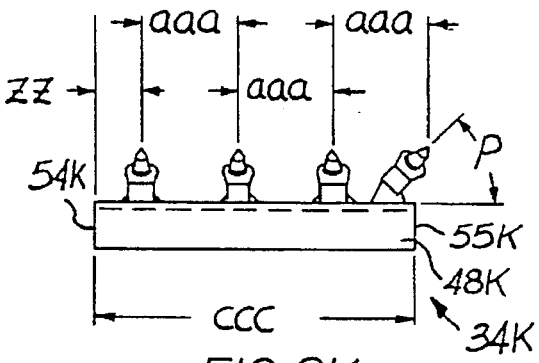
Figure 6L:
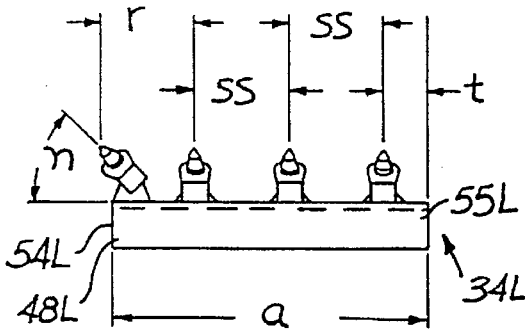
Figure 6M:
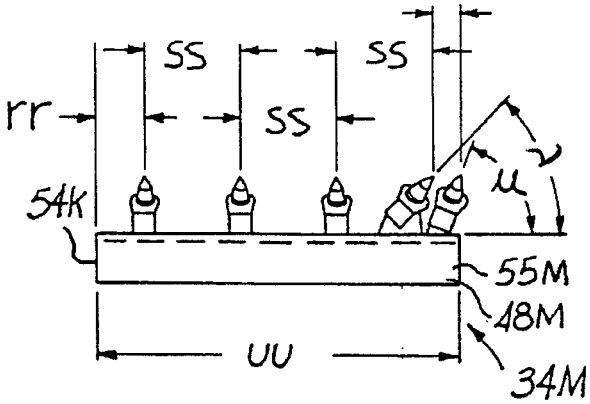
Figure 6N:
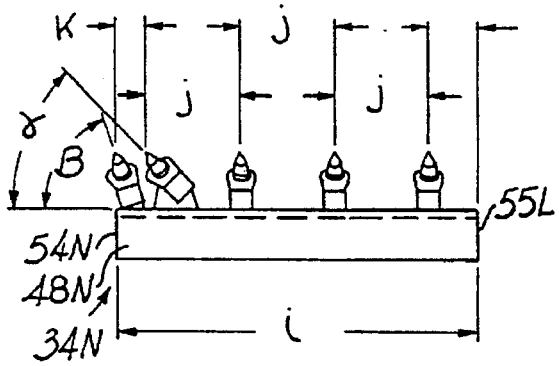

The next bar assembly 34N, which carries five bit assemblies, is depicted in more detail in FIG. 6N. Bar 48N has opposite ends 54N and 55N. Bar 48N has an overall length "i" of 18,337 inches. The spacing "j" between the centers of the four bits nearest to the other end 55N of bar 48N is 4.800 inches. The spacing "k" between the centers of the two bits nearest to the one end 54N of bar 48N is 1.537 inches. The other end 55N of the bar 48N is spaced from its nearest bit a distance "l" equal to 2.400 inches. The road milling bit assembly that is nearest to the one end 54N of the bar 48N is oriented at an angle "β" with respect to horizontal equal to 70 degrees. Bar 48N is positioned so that the one end 54N thereof is aligned with the one end 30 of the road milling drum. Because of the nature of the orientation of the road milling bit nearest to the one end 54N this bit cuts a side clearance for the drum. The road milling bit assembly that is second nearest to the one end 54N of the bar 48N is oriented at an angle "γ" with respect to the horizontal and is equal to 50 degrees.

The next two bar assemblies 34D are like the first seven and they are shown in more detail in FIG. 6D. The bars 48D progressively move laterally away from the equator A—A of the drum as the bar moves toward the top of the illustration in FIG. 5. In this specific embodiment, the lateral progression of each bar 34D away from the equator is 0.200 inches.

The next five bar assemblies 34E are depicted in more detail in FIG. 6E. Bar 48E carries four bit assemblies and has opposite ends 54E and 55E. The spacing "n" between the centers of the three bits nearest to the other end 55E of the bar 48E is 4.800 inches. The distance "o" between the center of the bit nearest to the other end 55E of the bar and the other end 55E of the bar is 2.400 inches. The spacing "p" between the centers of the two bits nearest to the one end 54E of the bar 48E is 3.160 inches. The bit assembly nearest to the one end 54E of the bar 48E is oriented at an angle "ε" to the horizontal and is equal to 50 degrees. The bars 48E progressively move laterally away from the equator A—A of the drum as the bar moves toward the top of the illustration in FIG. 5. In this specific embodiment, the lateral progression of each bar 34E away from the equator is 0.200 inches.

The next bar assembly 34L is depicted in more detail in FIG. 6L. Bar 48L carries four bit assemblies and has opposite ends 54L and 55L. The overall length "q" of bar 48L is 16.160 inches. The distance "r" between the centers of the two bit assemblies nearest to the one end 54L of the bar 98 is 4.737 inches. The distance "s" between the centers of the three bit assemblies nearest to the other end 55L of the bar 48L is 4.800 inches. The distance "t" between the other end 55L and the center of the bit nearest thereto is 2.400 inches. The bit assembly nearest the one end 54L of the bar 48L has an orientation of an angle "η" with respect to the horizontal and is equal to 50 degrees.

The next seven bar assemblies 34B are shown in more detail in FIG. 6B. Bar 48B carries four bit assemblies and has opposite ends 54B and 55B. The overall length "u" of the bar 48B is 17.800 inches. The distance "v" the centers of each of the bits is spaced apart equals 4.800 inches. The distance "w" between the one end 54B of the bar 48B and the center of the bit closest thereto is 2.400 inches. The distance "x" between the other end 55B of the bar and the center of the bit closest thereto is 1.000 inches. These bars 48B move progressively laterally outwardly from the equator A—A as the bar 48B moves upwardly on the illustration of FIG. 5. In this specific embodiment, the lateral progression of each bar 34B away from the equator is 0.200 inches.

The last bar assembly 34J on FIG. 5 is shown in more detail in FIG. 6J. Bar 48J carries five bit assemblies and has opposite ends 54J and 55J. The overall length "y" of bar 48J is 18.537 inches. The four bits nearest to the other end 55J of the bar 48J are spaced apart a distance "z" equal to 4.800 inches. The one end 54J is spaced from the center of the bit nearest thereto a distance "aa" equal to 3.137 inches. The other end 55J of the bar 48J is spaced from the center of its nearest bit a distance "bb" which is equal to 1.00 inches. The bit assembly that is nearest to the one end 54J of the bar 48J has an orientation of an angle "θ" with respect to horizontal and is equal to 60 degrees.

There are two rows of bars that comprise the second region of bars 78. Referring to the first row indicated by the brackets in FIG. 5 as 86, which of the two rows is the row nearest to the one end 30 of the drum 26, beginning at the bottom of the drum 26 in FIG. 5 the first bar assembly 34D is depicted in more detail in FIG. 6D, and has been previously described so that a further description is not necessary.

The next four bar assemblies 34H are depicted in more detail in FIG. 6H. Bar 48H carries five bit assemblies and has opposite ends 54H and 55H. The distance "dd" between the centers of all five bits is 4.800 inches. The overall length "cc" of the bar is 21.600 inches. The one end 54H of the bar 48H is spaced a distance "ee" apart from the center of its nearest road milling bit. The bit assembly that is nearest to the other end 55H of the bar 48H has an orientation of an angle "κ" with respect to the horizontal and is equal to 60 degrees. These four bars 48H move progressively laterally away a distance from the equator A—A of the drum 26 as they move toward the top of the illustration in FIG. 5. In this specific embodiment, the lateral progression of each bar 34H away from the equator is 0.200 inches.

The next eleven bar assemblies 34F are depicted in more detail in FIG. 6F. Each bar 48F carries five bit assemblies and has opposite ends 54F and 55F. The center of the bit that is closest to the other end 55F of the bar 48F is spaced therefrom a distance "ff" equal to 1,000 inches. The centers of the five bits are spaced apart a distance "gg" equal to 4.800 inches. The one end 54F of bar 48F is spaced a distance "hh" of 2.400 inches from the center of the nearest bit. The overall length "ii" of the bar 34F equals 22.600 inches. Each one of the bars 48F moves progressively laterally away from the equator A—A of the drum as the bars 48F move toward the top of the illustration in FIG. 5. In this specific embodiment, the lateral progression of each bar 34F away from the equator is 0.200 inches.

The next eight bar assemblies 34B are depicted in more detail in FIG. 6B. These bar assemblies 34B have already been described in detail so that a further description is not necessary. Each one of the bars 48B moves progressively laterally away from the equator A—A of the drum as the bars 48B move toward the top of the illustration in FIG. 5. In this specific embodiment, the lateral progression of each bar 34B away from the equator is 0.200 inches.

Referring to the second row indicated by the brackets 88, which of the rows is the row nearest to the other end 32 of the drum 26, beginning at the bottom of the drum 26 in FIG. 5, the first bar 34A is depicted in more detail in FIG. 6A. Bar 48A carries five bit assemblies and has opposite ends 54A and 55A. The center of the bit nearest the one end 54A of the bar 48A is spaced therefrom a distance "jj" which equals 1,000 inches. The centers of the five bits are spaced apart a distance "kk" of 4.800 inches. The other end 55A of the bar 48A is spaced a distance "ll", which is equal to 2.400 inches, from the center of its nearest bit. The overall length "mm" of the bar 48A is 22.600 inches.

The next four bar assemblies 34G are depicted in more detail in FIG. 6G. Bar 48G carries five bit assemblies and has opposite ends 54G and 55G. The centers of all five bits are spaced apart a distance "nn" equal to 4.800 inches. The other end 55G of the bar 48G is spaced from the center of from its nearest bit a distance "oo" equal to 2.400 inches. The overall length "pp" of the bar 48G is 21.6 inches. The bit assembly that is nearest to the one end 54G of the bar 48G has an orientation with respect to the horizontal of an angle "λ" and is equal to 60 degrees. These four bar assemblies 34G move laterally away from the equator A—A of the drum as the bar assemblies move toward the top of the illustration of FIG. 5. In this specific embodiment, the lateral progression of each bar 34G away from the equator is 0.200 inches.

The next eleven bar assemblies 34A are depicted in more detail in FIG. 6A. These bar assemblies have already been described in detail so that an additional description is not necessary. These eleven bars 48A move progressively laterally away from the equator A—A of the drum as they move toward to the top of the illustration in FIG. 5. In this specific embodiment, the lateral progression of each bar 34A away from the equator is 0.200 inches.

The next eight bar assemblies 34D are depicted in more detail in FIG. 6D. These bar assemblies have already been described in detail so that a description is not necessary. These eight bars 48D move progressively laterally away from the equator A—A of the drum as the bars 48D move toward to the top of the illustration in FIG. 5. In this specific embodiment, the lateral progression of each bar 34D away from the equator is 0.200 inches.

Referring to the third region of bars 80, it comprises a single row of bars equi-spaced about the circumference of the drum. The circumferential spacing between sequential bars is like that for the first region of bars 76 so that each bar is spaced about 15 degrees apart about the circumference of the drum.

Beginning at the lower point of FIG. 5, the third region includes seven circumferentially spaced apart bar assemblies 34B. These bars have already been described in detail so that a description is not necessary. These seven bars 48B move progressively laterally away from the equator A—A of the drum as the bars 48B move toward to the top of the illustration of FIG. 5. In this specific embodiment, the lateral progression of each bar 34B away from the equator is 0.200 inches.

The next bar assembly 34M, which carries five road milling bit assemblies, is depicted in more detail in FIG. 6M. Bar 48M has opposite ends 54M and 55M. The center of the bit nearest to the one end 54M of the bar 48M is spaced apart therefrom a distance "rr" of 2.400 inches. The centers of the three bits nearest to the one end 54M of the bar 48M are spaced apart a distance "ss" equal to 4.800 inches. The centers of the two bits nearest the other end 55M of the bar 48M are spaced apart a distance "tt" equal to 1.537 inches. The overall length "vv" of the bar is 18.337 inches. The bit assembly nearest to the other end 55M of the bar 48M is orientated at an angle "μ" with respect to the horizontal and is equal to 70 degrees. The bit assembly that is second nearest to the other end 55M of the bar 55M is oriented at an angle "ν" with respect to the horizontal and is equal to 50 degrees.

The next two bar assemblies 34B are like the first seven bar assemblies 34B and they are shown in more detail in FIG. 6B. These bars 48B move laterally away from the equator A—A of the drum as the bars move toward the top of the illustration in FIG. 5. In this specific embodiment, the lateral progression of each bar 34B away from the equator is 0.200 inches.

The next five bar assemblies 34C are depicted in more detail in FIG. 6C. Bar 48C carries four bit assemblies and has opposite ends 54C and 55C. The one end 54C of the bar 48C is spaced from the center of the bit that is nearest thereto a distance "vv" that equals 2.400 inches. The centers of the three bits nearest to the one end 54C of the bar 48C are spaced part a distance "ww" equal to 4.800 inches. The centers of the two bits nearest to the other end 55C of the bar 48C are spaced apart a distance "xx" equal to 4.160 inches. The bit assembly nearest to the other end 55C of the bar has an orientation of an angle "π" with respect to the horizontal and is equal to 50 degrees. These bars 48C move laterally away from the equator A—A of the drum as the bars move toward the top of the illustration in FIG. 5. In this specific embodiment, the lateral progression of each bar 34C away from the equator is 0.200 inches.

The next bar assembly 34K is depicted in more detail in FIG. 6K. Bar 48K carries four bit assemblies and has opposite ends 54K and 55K. The one end 54K of the bar 48K is spaced a distance "zz" away from the center of the bit which is nearest thereto that equals to 2.400 inches. The centers of the three bits nearest to the one end 54K of the bar 48K are spaced apart a distance "aaa" equal to 4.800 inches. The distance "bbb" between the centers of the two bits nearest to the other end 55K of the bar 48K equals 4.737 inches. The overall length "ccc" of bar 48K is 16.160 inches. The bit assembly nearest to the other end of the bar has an orientation of an angle "ρ" with respect to the horizontal and is equal to 50 degrees.

The next seven bars assemblies 34D are shown in more detail in FIG. 6D. These bar assemblies 34D have already been described in detail so that an additional description is not necessary. These bars 48D move progressively laterally away from the equator A—A of the drum as the bars move up toward the top of FIG. 5. In this specific embodiment, the lateral progression of each bar 34D away from the equator is 0.200 inches.

The last bar assembly 34I on FIG. 5 is shown in more detail in FIG. 6I. This bar assembly 34I has a bar 48I that carries five bit assemblies and has opposite ends 54I and 55I. The centers of the four bits nearest to the one end 54I of the bar 48I are spaced apart a distance "ddd" equal to 4.800 inches. The centers of the two bits nearest to the other end 55I of bar 48I are spaced apart a distance "eee" which is 3.137 inches. The one end 54I is spaced from its nearest bit a distance "fff" equal to 1.000 inches. The overall length "ggg" of bar 48I is 18.537 inches. The bit assembly nearest to the other end 55I of the bar 48I is oriented at an angle "σ" with respect to the horizontal and is equal to 60 degrees.

It should be appreciated that the specific dimensions and specific angles set forth above in conjunction with the specific embodiment of FIGS. 6A through 6N are particular to the specific embodiment. The dimensions and angles are chosen so as to lead to certain results, and thus, these dimensions and angles can vary depending upon the particular road milling application. The angles at which the bits are oriented with respect to the horizontal can vary between about 30 degrees and about 90 degrees.

The bits of the road milling drum assembly 22 form a helical pattern on each side of the circular equator A—A of the drum. During operation, this helical pattern augers, or moves, the debris toward the equator of the drum. The first flight of the helix on the side of the drum that is nearest to the one end of the drum is comprised of the bit assemblies that fall within line B—B as illustrated in FIG. 5. The second flight is comprised of bit assemblies that fall within line C—C as illustrated in FIG. 5. The third flight is comprised of bit assemblies that fall within line D—D as illustrated in FIG. 5. The fourth flight is comprised of bit assemblies that fall within line E—E as illustrated in FIG. 5. The fifth flight is comprised of bit assemblies that fall within line F—F as illustrated in FIG. 5. The sixth flight is comprised of bit assemblies that fall within line G—G as illustrated in FIG. 5. The seventh flight is comprised of bit assemblies that fall within line H—H as illustrated in FIG. 5. The eighth flight is comprised of bit assemblies that fall within line I—I as illustrated in FIG. 5. The ninth flight is comprised of bit assemblies that fall within line J—J as illustrated in FIG. 5.

The flights of bits on the other side of the equator of the drum nearest to the other end of the drum follow a symmetric configuration to the bits on the one side of the drum. Thus, a detailed description is not necessary. Suffice it to say that the first through ninth flights on the other side of the equator nearest to the other end 32 of the drum are defined by those bits that fall within lines K—K through S—S, respectively.

It can be appreciated that the specific embodiment is made from modular components such as the various bar assemblies. The present invention is not limited to the specific bar assemblies discussed above, but is intended to encompass the general use of bar assemblies in connection with rotatable drums. The bar assembly can be made to accommodate many specific applications so as to provide many different impingement point spacings. The bar assemblies can be made prior to manufacture and kept in stock so that a drum can be made in a relatively short amount of time. The bars can accept any manufacturer's block design and thus are not limited to a specific style of block.

The use of the bars affixed to the drum also helps to strengthen the drum. The additional structural support provided by the bars without adding a lot of excess weight is a desirable feature of the present invention.

In the operation of the specific embodiment illustrated in FIGS. 4 and 5, the drum is powered by the engine in the road milling machine so as to rotate the drum and thereby drive the road milling bits into impingement with the surface of the roadway substrate and continued passage through the substrate. The bars of this specific embodiment are generally parallel to the longitudinal axis T—T of the drum and all of the bits on each bar are in the same plane that is parallel to the longitudinal axis of the drum. Thus, all of the bits on each bar will impinge upon the roadway substrate at the same time. Although this is not considered to be a disadvantage, the power requirement for the engine will peak on an intermittent basis. In the specific embodiment of FIGS. 4 and 5, at each point in time where the impingement occurs, the bits on two bars that are in lateral alignment will simultaneously impinge the substrate.

As the road milling machine continues to operate it generates debris. This debris must be directed to the center of the housing so that it can be loaded on a conveyor. The conveyor moves the debris to a waiting dump truck for transport to a remote location. The bars 48 of the present embodiment project above the surface of the drum so that these bars 48 act as baffles to direct the debris to the center of the drum. By directing the debris, the bars facilitate the collection and removal of the debris.

During a road milling operation it may become necessary to change the bits. Typically, a pneumatic hammer is used to knock the old bits out of the bores of the blocks which carry the bits. The bars position the bits off of the surface of the drum and also provide sufficient space so that there is access to the rear of bits by an operator with a pneumatic hammer. The bars thus facilitate the changing of the bits on the drum.

Figure 7:
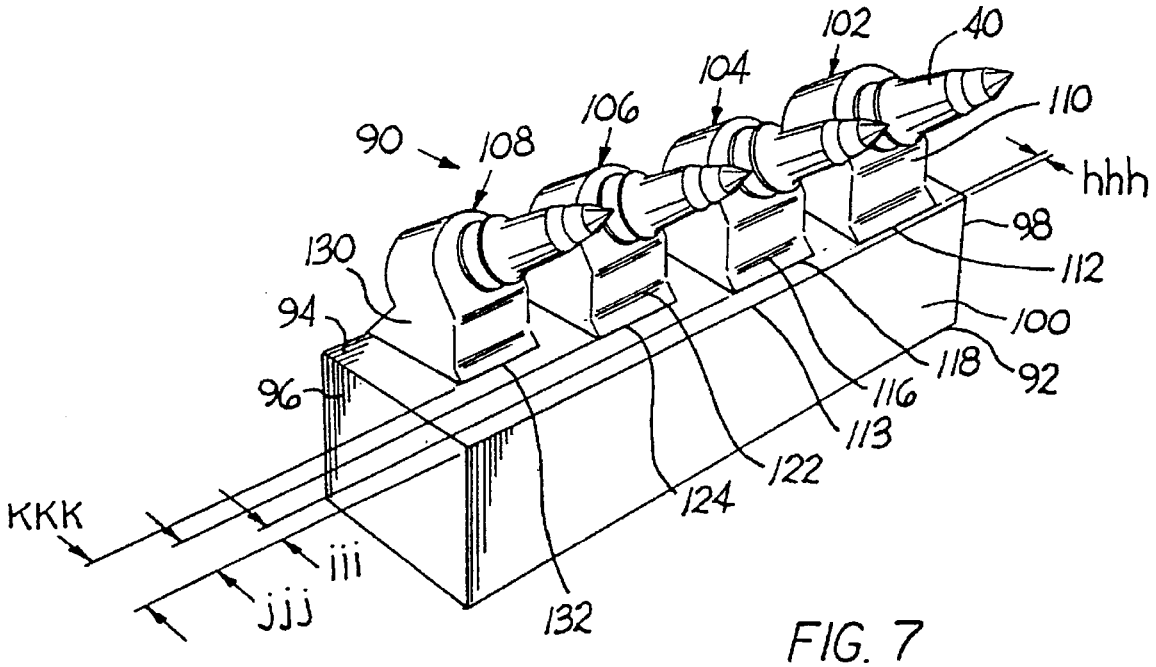
FIG. 7 is a perspective view of another specific embodiment of the road milling bar assembly showing an alternate way to connect the road milling bit assemblies to the bar.
Figure 8:
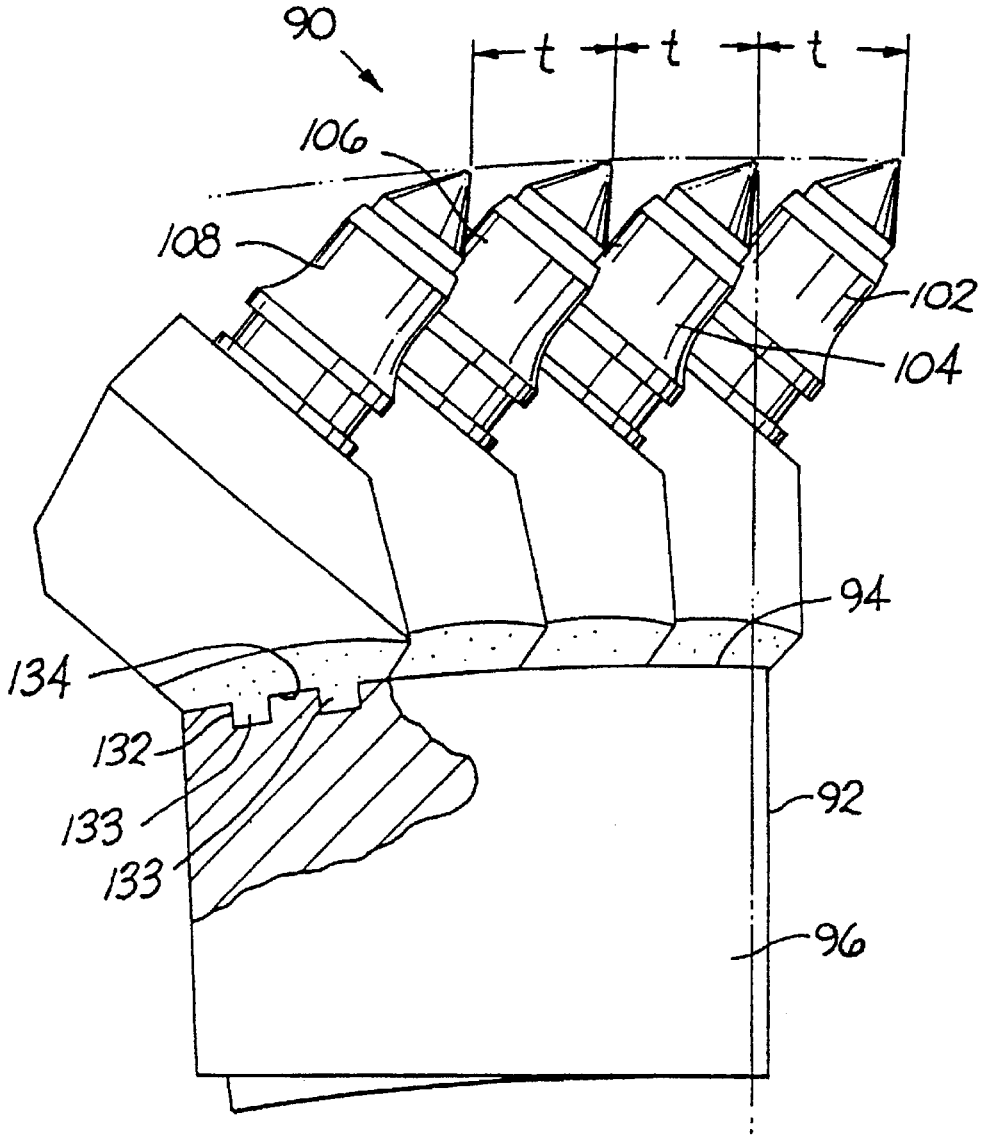
FIG. 8 is a side view of the structure of FIG. 7 wherein a part of the bar has been removed to show the connection between the block and the bar.

Referring to FIGS. 7 and 8, there is illustrated another specific embodiment of the bar assemblies generally designated as 90 in FIGS. 7 and 8. Bar assembly 90 includes an elongate generally rectangular bar 92 with a top surface 94, opposite ends 96, 98 and a front surface 100. Bar assembly 90 further includes four road milling bit assemblies (102, 104, 106, 108) which are structurally identical to the road milling bit assemblies that comprise a part of the first bar assembly 34.

The first road milling bit assembly 102 includes a block 110 having a front edge 112 and containing a bore which receives a road milling bit 40. The block 110 is affixed to the top surface 94 by welding or the like. The block 110 is positioned on the top surface of the bar so that the front edge 112 thereof is a distance "hhh" from the forward edge 113 of the top surface of the bar.

The second road milling bit assembly 104 includes a block 116 having a front edge 118 and containing a bore which receives a road milling bit 40. The block 116 is affixed to the top surface 94 by welding or the like. The block 116 is positioned on the top surface of the bar so that the front edge 118 thereof is a distance "iii" from the forward edge of the top surface of the bar.

The third road milling bit assembly 106 includes a block 122 having a front edge 124 and containing a bore which receives a road milling bit 40. The block 122 is affixed to the top surface 94 by welding or the like. The block 122 is positioned on the top surface of the bar so that the front edge 124 thereof is a distance "jjj" from the forward edge of the top surface of the bar.

The fourth road milling bit assembly 108 includes a block 128 having a front edge 130 and containing a bore which receives a road milling bit 40. The block 128 is affixed to the top surface 94 by welding or the like. The block 128 is positioned on the top surface of the bar so that the front edge 130 thereof is a distance "kkk"from the forward edge of the top surface of the bar.

As depicted in FIG. 8, the top surface 94 of the bar 92 has a pair of holes 132 which receive a pair of locator pins 133 that depend from the bottom surface 134 of the block 128. The locator pin-hole arrangement facilitates the proper orientation of the block on the top surface of the bar. Although not illustrated in the drawings of the first embodiment of the bar assembly 34, the use of the locator pin-hole arrangement is the preferred way to make certain that the blocks are correctly positioned on the top surface of the bar.

Still referring to FIGS. 7 and 8, the first through the fourth road milling bit assemblies are positioned progressively away from the forward edge of the top surface of the bar. Although the extent of this progressive movement may vary according to the application, the preferred orientation for this specific embodiment is that there be a two degree offset about the circumference of the drum as illustrated by angle "$\tau$" in FIG. 8.

One apparent structural feature of this specific embodiment of FIGS. 7 and 8 is that the laterally successive road milling bits are staggered across the length of the bar. Because the bits are staggered, all four bits do not impinge upon the surface of the roadway substrate at the same time. Consequently, there is not the sudden requirement of power from the engine to drive all four bits on this one bar through the substrate at once, but instead, the bits sequentially impinge the substrate so that the power requirement is relatively constant. The sequential impingement of the bits does not require as much power as does the intermittent impingement of all bits on a bar as is the case with the first specific embodiment of the bar assembly 34. The staggered arrangement of the road milling bits of the specific embodiment of FIGS. 7 and 8 does not affect the bit spacing across the length of the drum so that this specific arrangement still mills the roadway substrate so as to produce a surface texture that is the same as the surface texture produced by the specific embodiment of FIG. 4.

Figure 9:
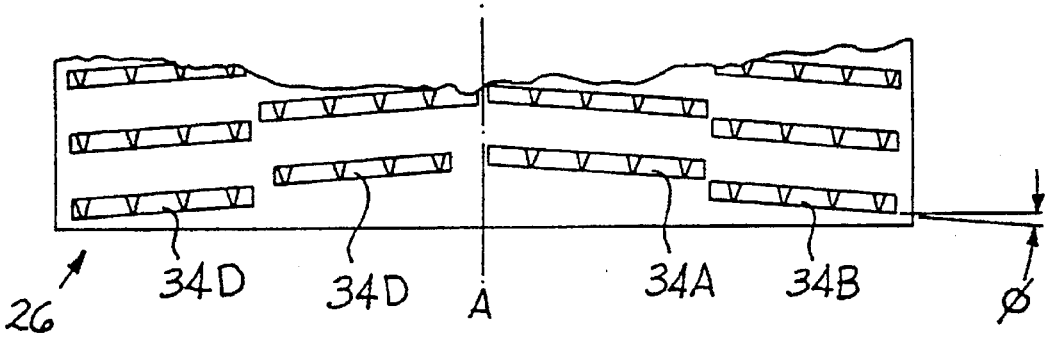
FIG. 9 is a partial mechanical schematic view showing an alternate orientation of the road milling bar assemblies on the surface of the road milling drum.

FIG. 9 illustrates an alternate specific embodiment of the bar assemblies 34 on the surface of the road milling drum 26. In the specific embodiment of FIG. 9, each bar assembly is oriented at an angle "$\phi$" so that it moves rearwardly on the surface of the drum as the bar assembly 34 moves laterally toward the equator A—A of the drum. Angle $\phi$ ranges between greater than 0° to about 4° with the preferred angle "$\phi$" being 2°.

By providing the orientation of FIG. 9, the road milling bits on each bar sequentially impinge upon the surface of the roadway substrate. As discussed above with respect to the embodiment of FIGS. 7 and 8, this orientation will not result in intermittent power requirements, but instead, will result in a more constant power requirement.

Figure 10:
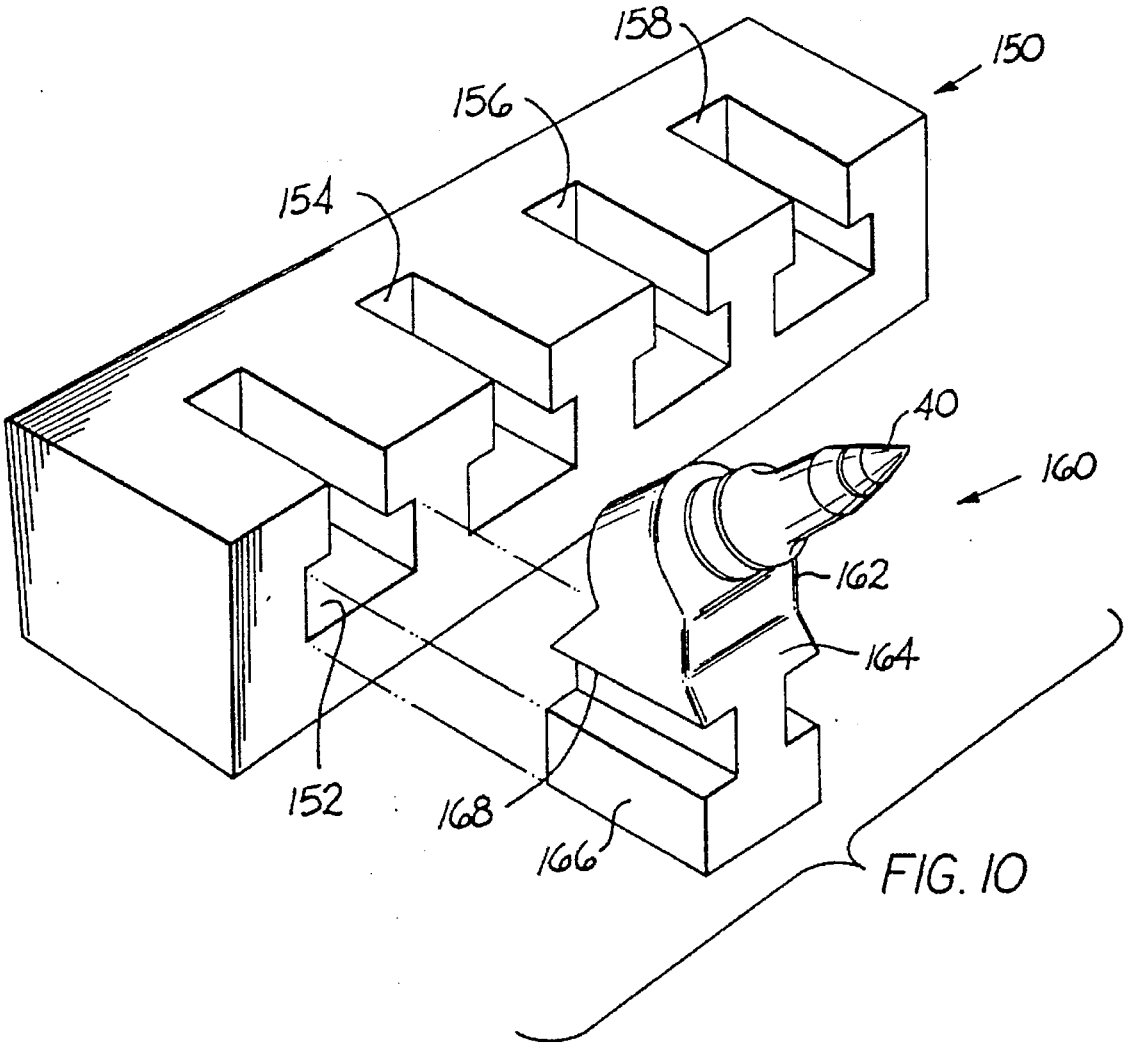
FIG. 10 is a perspective view of a road milling bar assembly that shows an alternate way to connect the road milling bit assemblies to the bar.

FIG. 10 illustrates an alternate way to connect the road milling bit to the bar. In this specific embodiment, the elongate rectangular bar 150 has four T-shaped channels 152, 154, 156 and 158 therein. The bit assembly 160 includes a block 162 with a block body 164 containing a bore which receives a road milling bit 40. A T-shaped flange 166 depends from the bottom surface 168 of the block body 164. To connect the bit assembly 160 to the bar 150, the flange of the each bit assembly is moved into its respective channel and secured therein in fashion as disclosed in U.S. Pat. No. 4,542,943, entitled EARTHWORKING TOOL FOR PROTECTING FROM ABNORMALLY HIGH CUTTING LOADS, and U.S. Pat. No. 4,542,943 is incorporated herein by reference.

Figure 11:
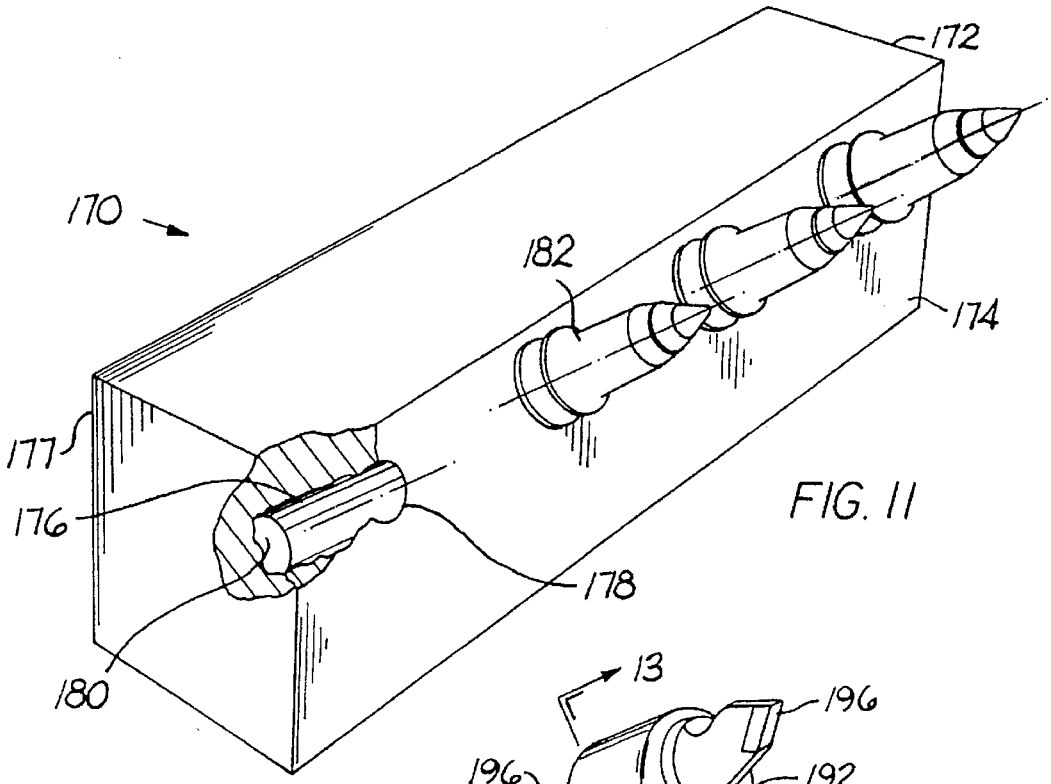
FIG. 11 is a perspective view of another specific embodiment of the invention wherein the bar contains a plurality of bores wherein each bore receives a road milling bit.

Referring to FIG. 11, there is illustrated a specific embodiment of a bar assembly generally designated as 170. Bar assembly 170 includes a bar 172 which has a front face or surface 174.

Bar 172 contains a plurality of bores 176 which extend through the bar from the front face to the rear face 177. One end 178 of the bore 176 is at the front face 174 of the bar 172 and the other end 180 of the bore 176 is at the rear face 177 of the bar 172.

Each bore 176 receives a rotatable road milling bit 182. For descriptive purposes FIG. 11 illustrates one of the bores being empty. However, in practice all four bores will receive a bit. Each bore receives its corresponding bit so that the bit 182 is rotatable with respect to the bar 172. The road milling bit 182 is identical to road milling bit 40 described above.

The bars 172 are positioned on the surface of a drum in a fashion like that for the embodiment of FIG. 5 so as to provide for a narrow bit spacing.

Figure 12:
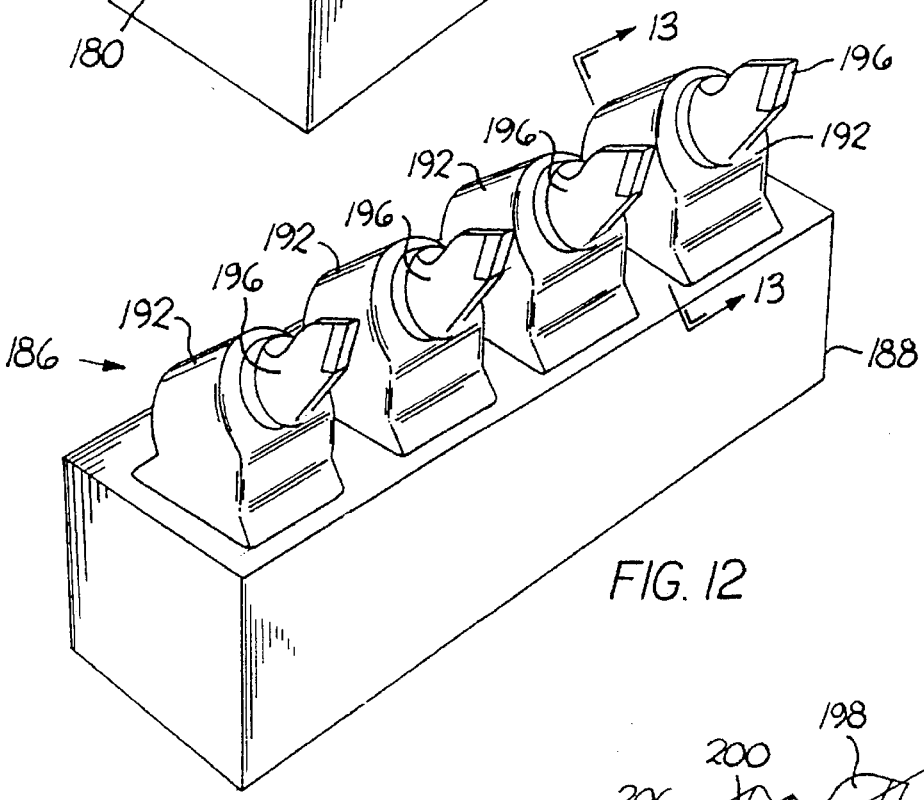
FIG. 12 is a perspective view of another specific embodiment of the invention wherein each block receives a non-rotatable road milling bit.
Figure 13:
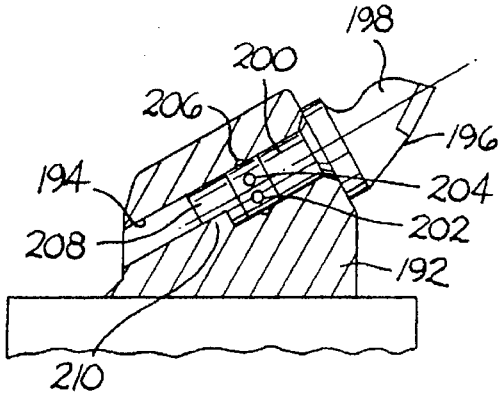
FIG. 13 is a cross-sectional view taken along section line 13—13 of FIG. 12.

FIGS. 12 and 13 depict a bar assembly generally designated as 186. Bar assembly 186 includes a bar 188 that has a top surface 190. A plurality of blocks 192 are affixed to the top surface 190 of the bar 188.

Each block 192 has a bore 194 therein that extends from the front face of the block to the rear face of the block. Each bore 194 receives a non-rotatable road milling bit 196 therein.

The non-rotatable road milling bit 186 has a forward head portion 198 and a rearward shank portion 200. The rearward shank 200 carries a resilient retainer ring 202 with bumps 204 that engage a corresponding channel 206 in the bore. The rear end of the shank has a notch 208 that engages the ledge 210 of the bore so as to render the bit 196 non-rotatable. A cemented carbide insert 199 is at the forward-most end of the head portion 198.

Figure 14:
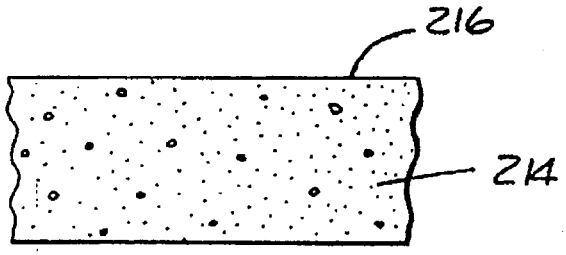
FIG. 14 is a cross-sectional view of a milled roadway substrate that was milled by a drum carrying all non-rotatable road milling bits such as depicted in FIGS. 12 and 13.

In the operation of a road milling drum assembly using the specific embodiment of FIGS. 12 and 13, the bits will impinge upon the surface of the substrate in a fashion like that for the other embodiments. However, the cemented carbide insert 199 presents a flat cutting edge that impinges upon the surface of the substrate. Because of the fact that the cutting edge of laterally adjacent road milling bits 186 will overlap, a milled roadway substrate milled with the road milling bits of FIGS. 12 and 13 will produce a relatively smooth surface with very little road noise. FIG. 14 illustrates the roadway substrate 214 which has a relatively smooth surface 216 when milled by a road milling drum assembly using the specific embodiment of FIGS. 12 and 13.

Other specific embodiments of the invention will be apparent to those skilled in the art from a consideration of this specification or practice of the invention disclosed herein. It is intended that the specification and specific embodiments be considered as exemplary only, with the true scope and spirit of the invention being indicated by the following claims.

What is claimed is:

1. A milled roadway surface wherein the milling operation is performed by a mining drum assembly with a drum having opposite ends and a generally cylindrical surface, a plurality of bars affixed to the surface of the drum, each one of the bars having a plurality of laterally-spaced apart blocks assemblies connected thereto, each one of the block assemblies carrying a mining bit, the bars define a first region of discrete bars equi-spaced about the circumference of the drum, the bars further define a second region of discrete bars equi-spaced about the circumference of the drum, and the bars of the first region being circumferentially and laterally spaced-apart from the bars of the second region, the milled roadway surface comprising:

a roadway substrate milled due to the impingement of the mining bits upon the roadway substrate to define a surface texture having an operative spacing of less than 0.200 inches.

2. A milled roadway surface comprising: a roadway substrate milled to define a surface texture having an operative spacing of about 0.100 inches.

3. A milled roadway surface comprising: a roadway substrate milled to define a surface texture having an operative spacing of less than about 0.100 inches.

* * * * *